US005941100A

United States Patent [19]

Ahn et al.

[11] Patent Number: 5,941,100

[45] Date of Patent: Aug. 24, 1999

[54] CLOTHES WASHING MACHINE HAVING A WATER-EJECTING PULSATOR FOR EJECTING FILTERED WATER

[75] Inventors: Ki-Pyo Ahn, Suwon; Sang-Won Lee, Pusan, both of Rep. of Korea

[73] Assignee: Samsung Electronics Co., Ltd., Suwon, Rep. of Korea

[21] Appl. No.: 09/050,126

[22] Filed: Mar. 30, 1998

[30] Foreign Application Priority Data

Jun. 30, 1997 [KR] Rep. of Korea ..... 97-29008
Jun. 30, 1997 [KR] Rep. of Korea ..... 97-29010

[51] Int. Cl.[6] ..... D06F 17/10; D06F 39/10

[52] U.S. Cl. ..... 68/18 FA; 68/53; 68/134

[58] Field of Search ..... 68/18 F, 18 FA, 68/53, 134

[56] References Cited

U.S. PATENT DOCUMENTS 2,642,733 6/1953 McCormick et al. ..... 68/18 FA X
2,722,118 11/1955 Guthrie ..... 68/18 FA X
4,420,952 12/1983 Brenner et al. ..... 68/53
5,829,276 11/1998 Suh et al. ..... 68/53

FOREIGN PATENT DOCUMENTS 229276 10/1996 Japan ..... 68/53

*Primary Examiner*—Philip R. Coe
*Attorney, Agent, or Firm*—Burns, Doane, Swecker & Mathis, L.L.P.

[57] ABSTRACT

A clothes washing machine has a pulsator and a spurting apparatus for spurting washing water upwardly from the center of the pulsator, so as to disperse laundry gathered thereabove. The spurting apparatus has at least one guide duct and a spurt cap. The guide duct is fixed to an underside of the pulsator so as to rotate together with the pulsator. The washing water is introduced into a radially outer end of the guide duct and guided toward the center of the pulsator. The spurt cap disposed at the center of the pulsator guides the washing water upwardly. A filter is disposed at an inlet of the duct for filtering-out impurities from washing water entering the duct.

8 Claims, 7 Drawing Sheets

CLOTHES WASHING MACHINE HAVING A WATER-EJECTING PULSATOR FOR EJECTING FILTERED WATER

BACKGROUND OF THE INVENTION

1) Field of the Invention

The present invention relates to a clothes washing machine, and more particularly to a washing machine having a spin basket in which a pulsator is mounted for rotation.

2) Prior Arts

Generally, a clothes washing machine is an appliance for washing laundry, in which a pulsator rotates to generate washing current for applying impact to the laundry, thereby washing the laundry.

FIG. 1 shows such a conventional washing machine. As shown, the conventional washing machine includes a housing 10 forming the outer appearance of the washing machine, a tub 11 installed in the housing 10 for containing a predetermined amount of washing water required for washing the laundry, and a spin basket 12 rotatably installed in the tub 11. A pulsator 13 for generating the washing current is mounted on the inner bottom of the spin basket 12, and a driving mechanism 14 for driving the spin basket 12 and the pulsator 13 is arranged under the tub 11. The driving mechanism 14 includes a motor 14*a* and a transmission 14*b*. The motor 14*a* generates the driving power, and the transmission 14*b* selectively drives the pulsator 13 and the spin basket 12 by means of the rotating force of the motor 14*a* transferred through a belt 14*c*.

Further, a drain hose 15 is provided at one side position under the tub 11 and extends out of the housing 10 to drain the washing water from the tub 11.

In the conventional washing machine as constructed above, when an electric power is applied after the laundry is put in the spin basket 12, the washing water is supplied into the spin basket 12 and then the pulsator 13 is rotated in one direction or alternately in opposite directions (i.e., oscillated) by the motor 14*a* to generate the washing current. The laundry flows according to the washing current and is washed by the friction occurring between the clothes and the washing water and the inner wall of the spin basket 12.

However, in such a conventional washing machine, the laundry usually becomes tangled together above the center of the pulsator to thereby diminish the washing performance. That is, the centrifugal force caused by the rotation of the pulsator drives the washing water toward the wall of the spin basket. As a result, the washing water is deeper at the outer periphery of the pulsator, than at the center thereof. Therefore, the clothes come into closer contact above the center of the pulsator. Such gathered laundry above the center of the pulsator goes on rotating in one direction or alternately in opposite directions along with the pulsator, so that the laundry becomes severely tangled together, thereby diminishing the washing performance of the washing machine and even damaging the laundry.

SUMMARY OF THE INVENTION

The present invention has been made to overcome the above described problems of the prior art, and accordingly it is an object of the present invention to provide a washing machine, in which washing water spurts upwardly from the center of a pulsator, so as to disperse the laundry gathered thereabove.

It is another object of the present invention to provide a washing machine having a washing water spurting apparatus which can filter off impurities from the washing water, so as to maintain the interior of the washing machine clean, and as well to prevent the impurities from adhering to the laundry.

To achieve the above object, the present invention provides a washing machine comprising:

a housing;

spin basket installed in the housing;

a pulsator rotatably mounted on a bottom of the spin basket;

a washing water spurting apparatus assembled with the pulsator, the washing water spurting apparatus including at least one guide duct and a spurt cap, the guide duct having an inlet and an outlet, the guide duct guiding a washing water from the inlet to the outlet toward a center of the pulsator, the spurt cap spurting the washing water guided by the guide duct directly upward above the center of the pulsator; and a filter for filtering out impurities from the washing water, said filter installed at the inlet of the guide duct.

BRIEF DESCRIPTION OF THE DRAWINGS

The above object, and other features and advantages of the present invention will become more apparent by describing preferred embodiments thereof in detail with reference to the attached drawings, in which.

DESCRIPTION OF A PREFERRED EMBODIMENT

Hereinafter, a preferred embodiment of the present invention will be described in detail with reference to the accompanying drawings, and like elements will be numbered the same in the following description.

Figure 1:
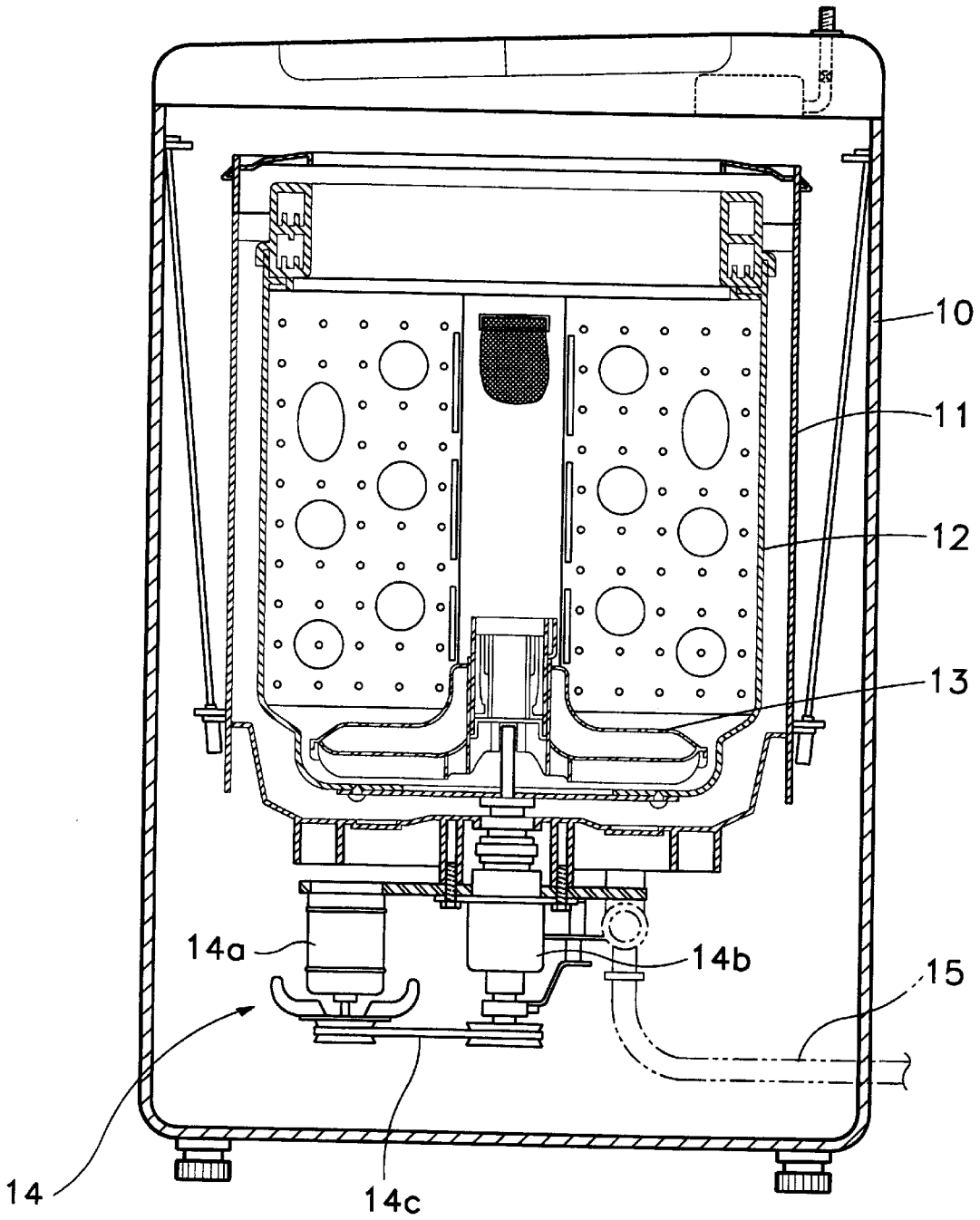
FIG. 1 (PRIOR ART)
FIG. 1 is a sectional view of a conventional washing machine for showing the inner construction thereof.
Figure 2:
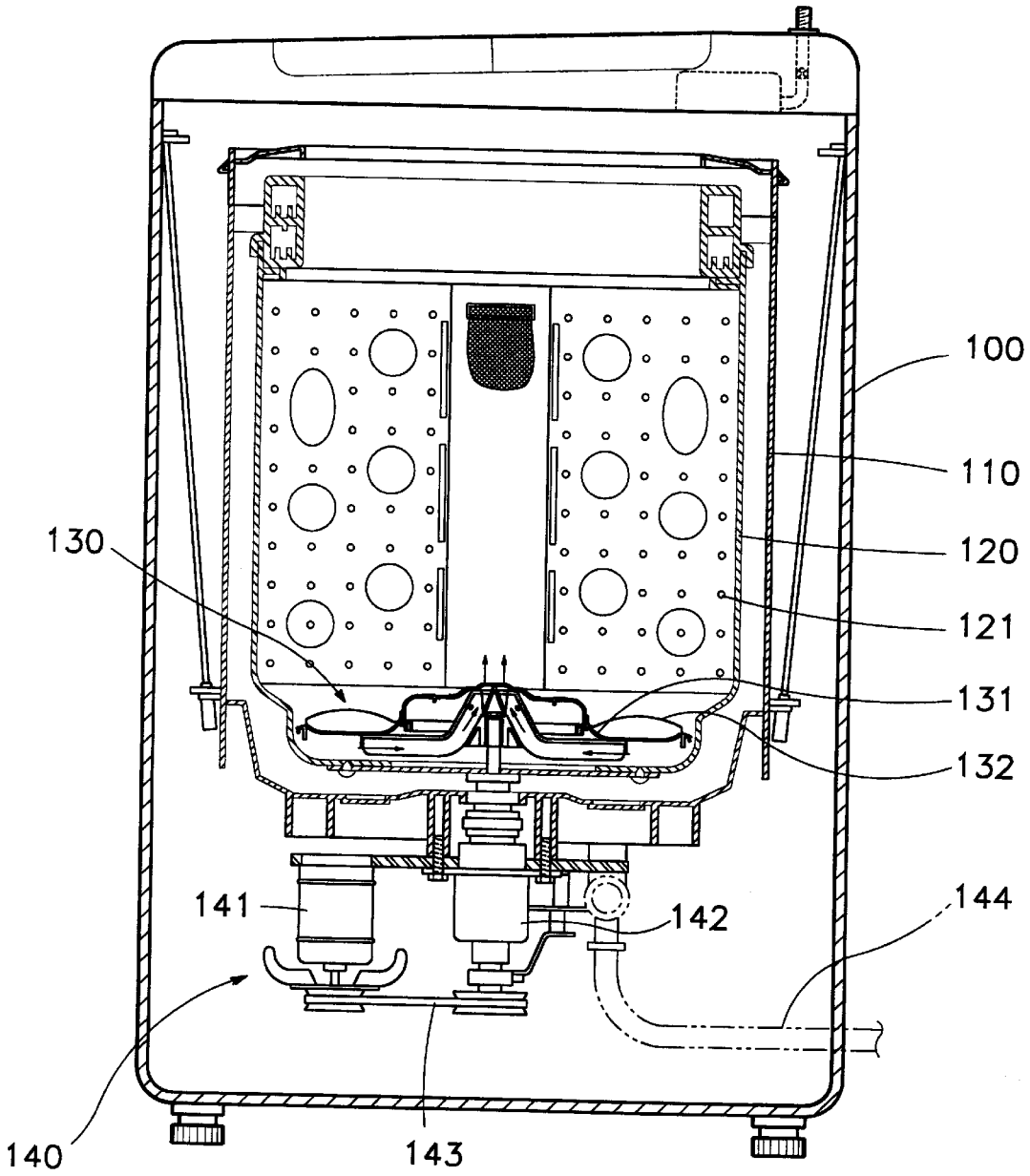
FIG. 2 is a sectional view of a washing machine according to an embodiment of the present invention, which shows the inner construction thereof.

FIG. 2 is a sectional view of a preferred embodiment of a washing machine according to the present invention, for showing the inner construction thereof.

As shown, the washing machine according to the present invention has a housing 100 forming the outer appearance of the washing machine. A control section (not shown) is arranged in an upper portion of the housing 100, and a tub 110 for containing the washing water is mounted in the housing 100. A spin basket 120 formed with a plurality of holes 121 is rotatably installed in the tub 110. On the bottom of the spin basket 120 is installed a pulsator 130 which includes a rotating plate 131 carrying a plurality of blades 132 arranged radially and protruding upward from the upper surface of the rotating plate 131. The pulsator 130 generates the washing current when it rotates in one direction or alternately is oscillated in opposite directions.

A driving mechanism 140 for driving the spin basket 120 and the pulsator 130 is arranged under the tub 110. The driving mechanism 140 includes a motor 141 and a transmission 142. The motor 141 produces the driving power, and the transmission 142 selectively rotates the pulsator 130 and the spin basket 120 by means of the rotating force of the motor 141 transferred through a belt 143. The transmission 142 rotates either the pulsator 130 alone, when the laundry is being washed, or it rotates the spin basket 120 and the pulsator 130 together when the laundry is being dehydrated (spin-drying). A drain hose 144 is provided at one side position under the tub 110 and extends out of the housing 100 to drain the washing water from the tub 110.

The pulsator 130 further includes a washing water spurting apparatus for spurting (ejecting) the washing water upwardly from the center of the pulsator to thereby prevent the laundry from being gathered and tangled.

Figure 3:
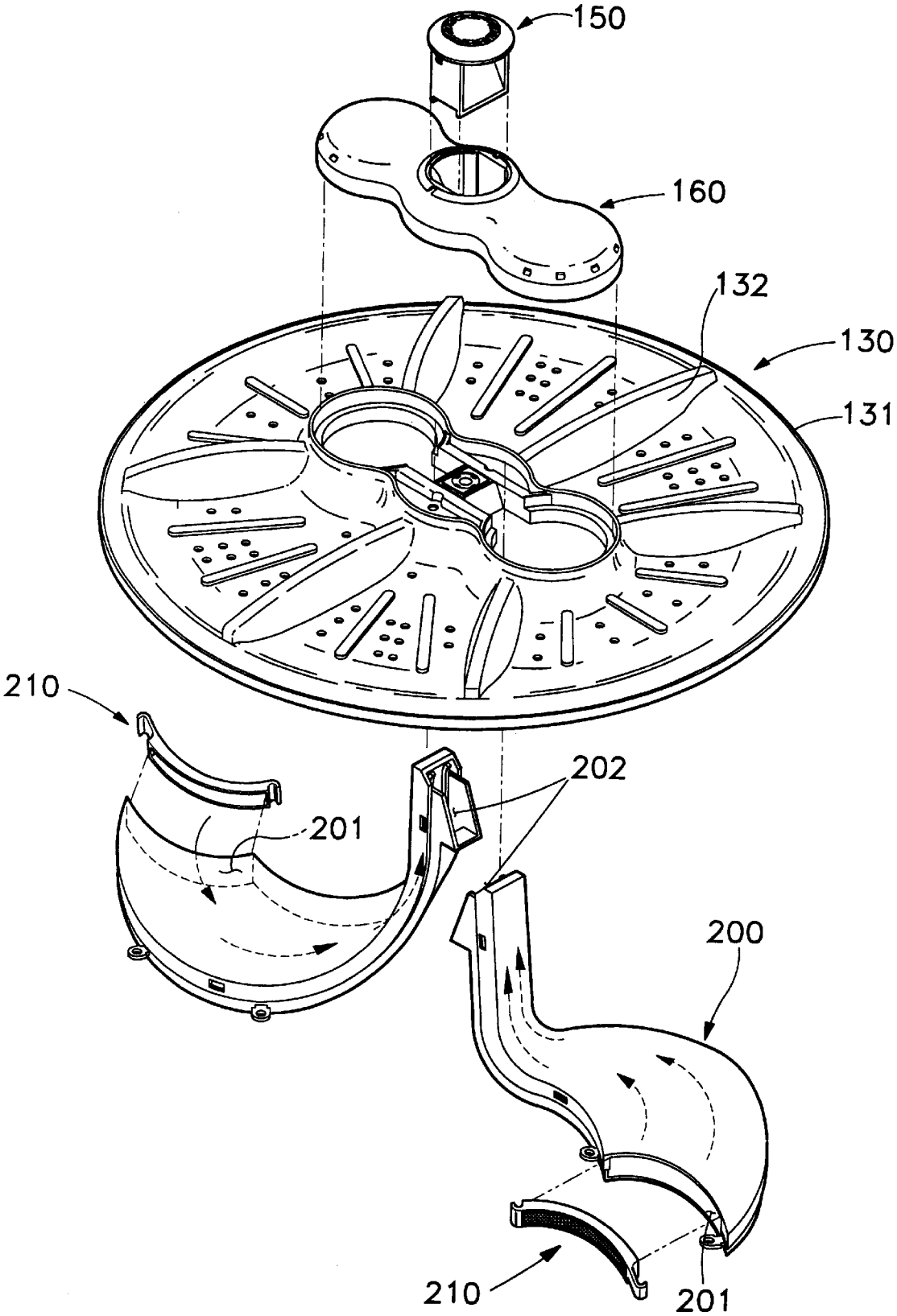
FIG. 3 is an exploded perspective view of a pulsator and a washing water spurting apparatus installed to the pulsator, which are employed in the washing machine shown in FIG. 2.

FIG. 3 is an exploded perspective view for showing in detail the construction of the pulsator and the washing water spurting apparatus according to the present invention.

The washing water spurting apparatus includes a guide duct 200 and a spurt cap 150. The guide duct 200 is fixed to the underside of the pulsator 130 so as to rotate together with the pulsator 130, thereby receiving washing water and guiding the washing water to the center of the pulsator 130. The spurt cap 150 is disposed at the center of the pulsator 130, so as to upwardly direct the washing water, guided by the guide duct 200, to a location above the center of the pulsator 130.

Although the washing water spurting apparatus may include only one guide duct 200, it is preferable to provide a pair of guide ducts 200 fixed to the pulsator 130 in opposing relationship to each other, in consideration of the space available for locating the guide ducts 200 and the need to keep the pulsator 130 dynamically balanced.

Each guide duct 200 has an inlet 201 formed at a radially outer end thereof and an outlet 202 formed at a radially inner end thereof. When the pulsator 130 rotates, the washing water is caused to enter the guide duct 200 through the inlet 201, and exit the guide duct 200 through the outlet 202 in an upward direction at the center of the pulsator 130. The cross sectional area of the guide duct 200 gradually decreases from the inlet 201 to the outlet 202, so that the flowing speed of the washing water increases as it goes from the inlet 201 to the outlet 202, whereby a strong upward spurt of the washing water occurs at the outlet 202. Further, the inlet 201 of the guide duct 200 faces in a horizontal direction, while the outlet 202 thereof faces upwardly.

Reference numeral 160 designates a supplementary blade. The supplementary blade 160 is fixed to the pulsator 130 and rotates together with the pulsator 130 to make the vortex of the water current more violent.

Figure 4:
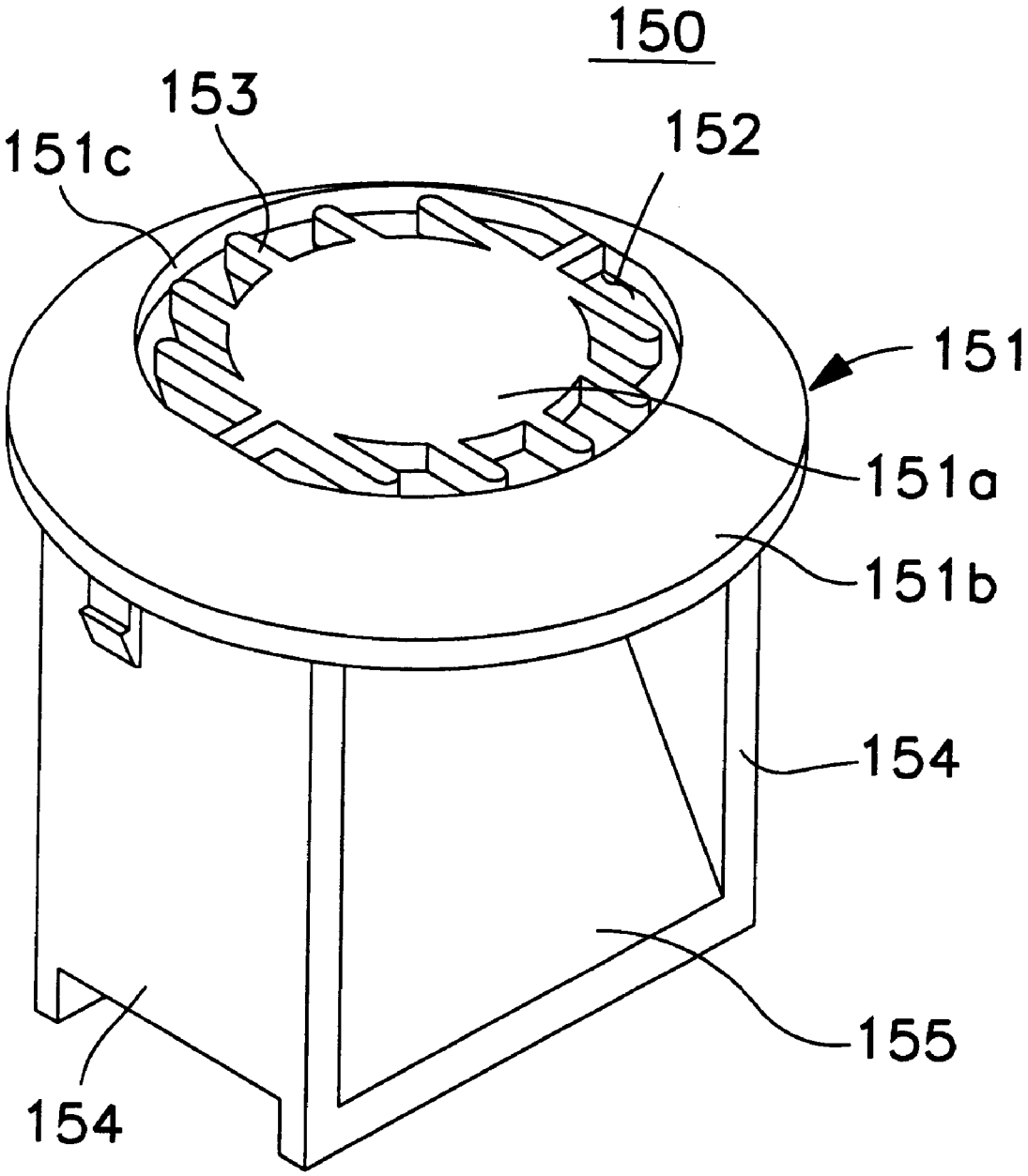
FIG. 4 is a perspective view of a spurt cap of the washing water spurting apparatus shown in FIG. 3.

FIG. 4 is a perspective view of a spurt cap of a washing water spurting apparatus shown in FIG. 3. As shown, the spurt cap 150 includes a canopy 151, a pair of side plates 154, and a pair of guide plates 155. The canopy 151 is shaped like a frusto-arcuate disc having a vertical spurt hole 152 through which the washing water spurts. The side plates 154 extend downward from the canopy 151 in diametrically opposed, parallel relationship. The guide plates 155 are disposed between the side plates 154 to support them, and guide the washing water from the outlet 202 of the guide duct 200 to the spurt hole 152. Only one guide plate 155 is depicted in FIG. 4. The other guide plate converges upwardly toward that shown guide plate, as shown in FIG. 2.

The canopy 151 includes a core 151*a* and an arcuate rim 151*b* surrounding the core 151*a*. The core 151*a* has a shape of a disc and serves as the ceiling of the canopy 251, and the spurt hole 152 is formed between a circumference of the core 151*a* and a cylindrical surface 151*c* of the arcuate rim 151*b*. The core 151*a* has a plurality of ribs 153 which protrude from the circumference of the core 151*a* toward a cylindrical inner surface 151*c* to partition the spurt hole 152. The ribs 153 reduce a cross sectional area of the spurt hole 152 through which the washing water passes, thereby increasing the spurting pressure of the washing water so as to create a strong spurt of the washing water. Moreover, the ribs 152 prevent relatively big alien materials such as a hairpin or a button from entering the guide duct 200 from above through the spurt hole 152 when the washing water is not spurted from the spurting cap 150.

Figure 5:
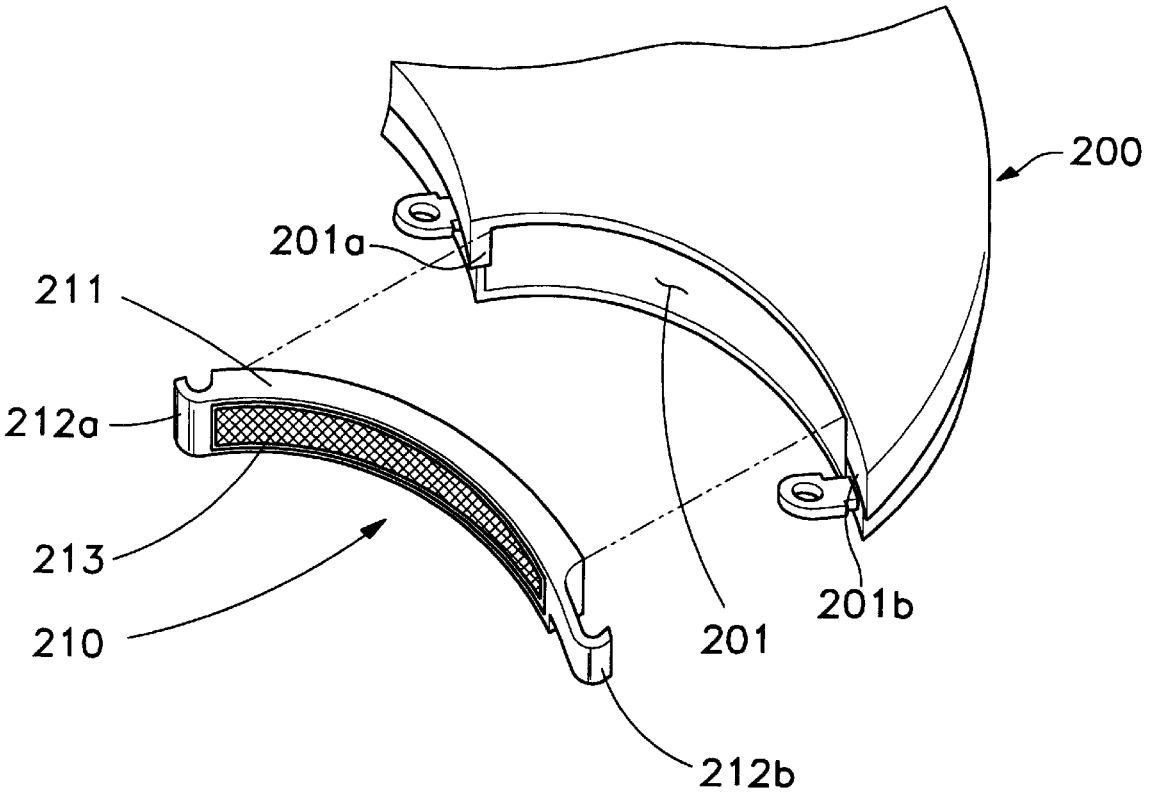
FIG. 5 is an exploded perspective view of a part of a guide duct and a filter assembled with the guide duct according to a first embodiment of the present invention.

A filtering means 210 for filtering out impurities from the washing water is installed at the inlet 201 of the guide duct 200, as shown in FIG. 5.

Referring to FIG. 5, the inlet 201 of the guide duct 200 is arcuate so that the washing water can easily flow thereinto, and the filtering means 210 has an arcuate shape corresponding to the arcuate shape of the inlet 201 so as to be assembled with the inlet 201 by being inserted thereinto.

The filtering means 210 includes side flanges 211, a first coupling jaw 212*a* and a second coupling jaw 212*b*, and a net mesh 213. The side flanges 211 have a size which enables them to be closely fitted in the inlet 201, and the side flanges 211 define a space therebetween through which the washing water can pass. The first coupling jaw 212*a* and the second coupling jaw 212*b* are bent from opposite ends of the side flanges 211 so as to respectively surround a first inflow end 201*a* and a second inflow end 201*b* of the inlet 201. The net 213 is provided in the space defined by the side flanges 211 so as to filter out impurities from the washing water when the washing water flows into the guide duct 200.

When the filtering means 210 is installed at the inlet 201, the side flanges 211 of the filtering means 210 are fittedly (frictionally) inserted into the inlet 201. Thereafter, the first coupling jaw 212*a* and the second coupling jaw 212*b* are pressed toward the first inflow end 201*a* and the second inflow end 201*b* of the inlet 201, so that the first inflow end 201*a* and the second inflow end 212*b* of the inlet 201 are closely fitted in the first coupling jaw 212*a* and the second coupling jaw 212*b*. Thus, the filtering means 210 is tightly assembled with the inlet 201.

Figure 6:
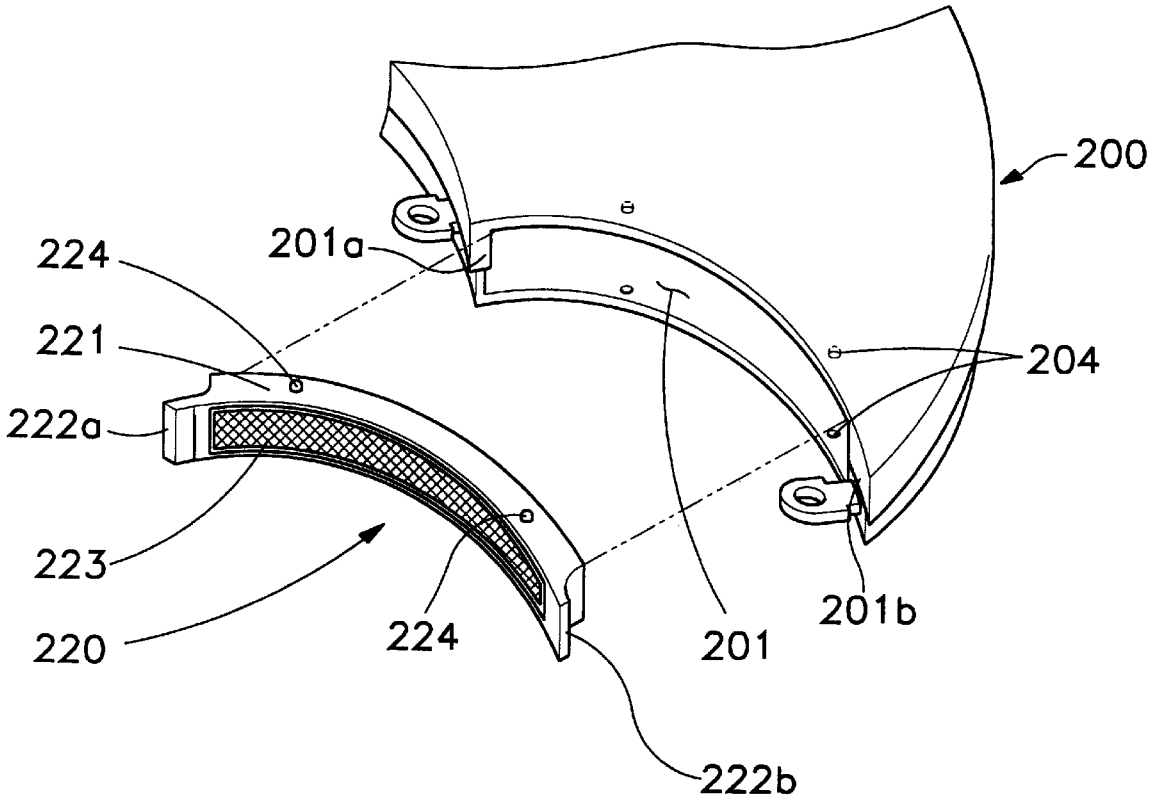
FIG. 6 is an exploded perspective view of a part of a guide duct and a filter assembled with the guide duct according to a second embodiment of the present invention.

FIG. 6 is an exploded perspective view of a part of a guide duct and another embodiment of a filter assembled with the guide duct.

As shown, the inlet 201 of the guide duct 200 is arcuate so that the washing water can easily flow thereinto, and the filtering means 220 also has an arcuate shape corresponding to the arcuate shape of the inlet 201 so as to be assembled with the inlet 201 by being inserted thereinto.

The filtering means 220 includes upper and lower side flanges 221, a first side tab 222*a* and a second side tab 222*b*, a plurality of protuberances 224, and a net or mesh 223. The side flanges 221 have a size which enables the side flanges 221 to be closely (frictionally) fitted in the inlet 201, and the side flanges 221 define a space therebetween through which the washing water can pass. The first side tab 222*a* and the second side tab 222*b* extend outward from opposite ends of the side flanges 221 so as to respectively be in contact with the first inflow end 201*a* and the second inflow end 201*b* of the inlet 201. The protuberances 224 protrude upward and downward from the upper and lower side flanges 221, respectively. The net 223 is provided in the space defined by the side flanges 221 so as to filter out impurities from the washing water when the washing water flows into the guide duct 200 through the net 223 and the space.

The guide duct 200 has a plurality of assembling holes 204 formed at the top and the bottom of the guide duct 200. The assembling holes 204 are located correspondingly to the protuberances 224 of the filtering means 220 so that the protuberances 224 may be inserted into the assembling holes 204.

When the filtering means 220 as constructed above is installed at the inlet 201, the side flanges 221 of the filtering means 220 are inserted in the inlet 201 while the protuberances 224 are inserted in the assembling holes 204 of the guide duct 200. Thus, the filtering means 210 is tightly assembled with the inlet 201.

Figure 7:
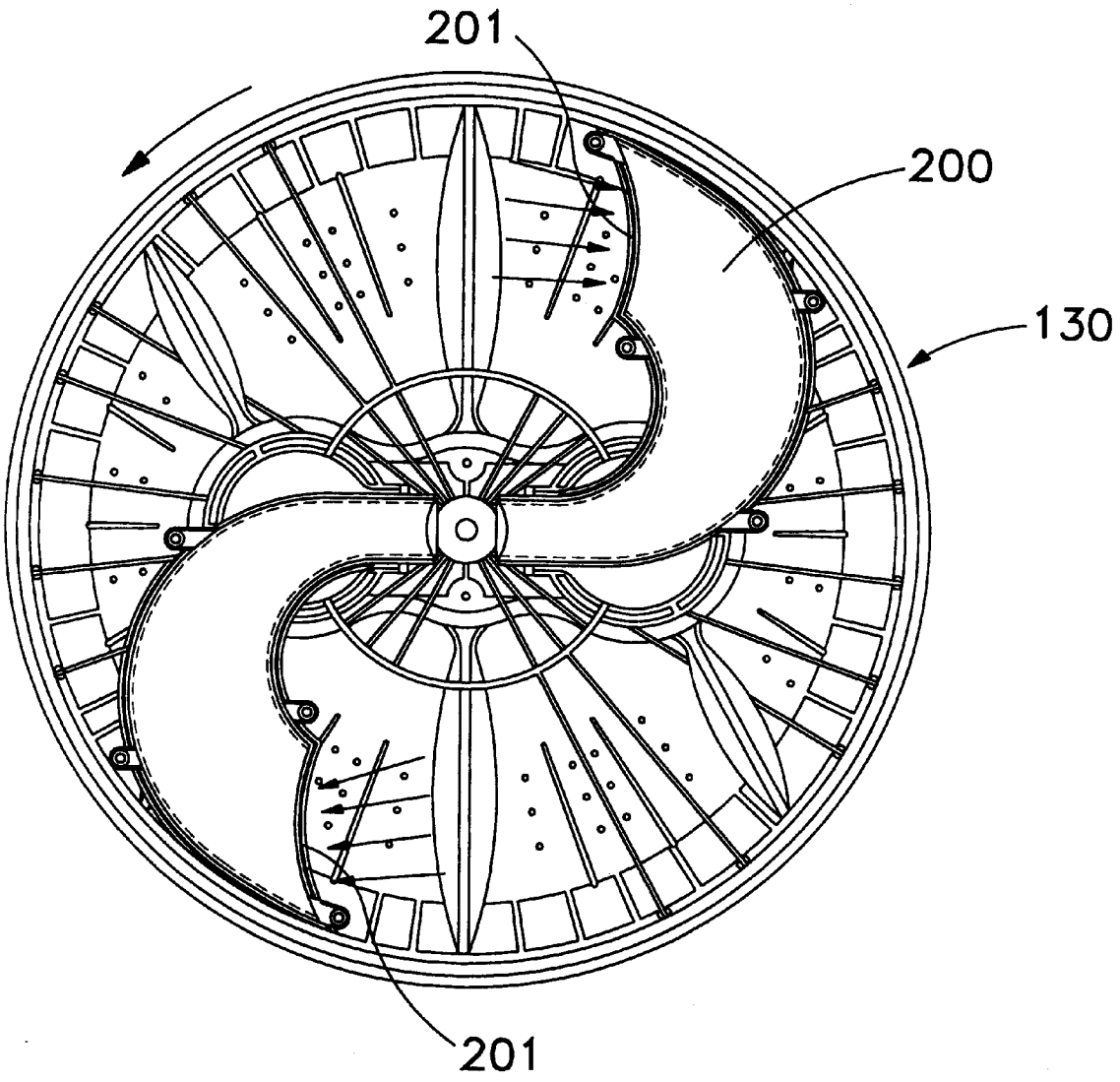
FIG. 7 is a bottom view of the pulsator with guide ducts of the washing water spurting apparatus shown in FIG. 3.

FIG. 7 is a bottom view of the pulsator with guide ducts of the washing water spurting apparatus shown in FIG. 3, which are assembled with the pulsator. Referring to FIGS. 2, 3 and 7, the operation of the washing machine as constructed above according to the present invention will be described hereinafter.

First, when the washing machine is driven by operating the control section (not shown) after putting the laundry in the spin basket 120, the washing water is introduced into the spin basket 120 and simultaneously into the guide ducts 200. Thereafter, an electric power is applied to the motor 141, whereupon the transmission 142 rotates the pulsator 130 in one direction or alternately in opposite directions by means of the rotating force transferred from the motor 141. In this case, the guide ducts 200 fixed to the lower surface 136 of the pulsator 130 rotate together with the pulsator 130. When the pulsator 130 rotates counterclockwise as shown in FIG. 7, the washing water continuously flows into the guide duct 200 through the inlet 201 by the rotating force of the pulsator 130. At this time, the filtering means 210 or 220 installed at the inlet 201 filter out the impurities from the washing water.

The washing water introduced into the guide ducts 200 as described above goes on flowing through the guide ducts 200 and then spurts upward from the center of the pulsator 130 through the outlet 202. In the meantime, as described above, since the cross sectional area of each guide duct 200 narrows from the inlet 201 to the outlet 202, the washing water flows gradually faster to eventually achieve a strong spurt through the outlet 202 and the spurt cap 150. Therefore, the laundry gathered above the center of the pulsator 130 during the washing can be dispersed by the strong spurt of the washing water.

As described above, the washing machine according to the present invention includes a washing water spurting apparatus for guiding and spurting the washing water upwardly from the center of the pulsator. The washing water spurting apparatus disperses the laundry gathered above the center of the pulsator to thereby prevent the laundry from being tangled and damaged, and at the same time the spurting washing water applies an impact to the laundry to thereby improve the washing performance of the washing machine.

The washing machine is further advantageous in that the washing water spurting apparatus can filter-out impurities from the washing water, so as to maintain the interior of the washing machine clean, and as well to prevent the impurities from adhering to the laundry.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A clothes washing machine comprising:

housing;

spin basket installed in the housing;

pulsator rotatably mounted at a bottom of the spin basket for agitating washing water therein;

washing water spurting apparatus assembled with the pulsator, the washing water spurting apparatus including at least one guide duct having a radial outwardly disposed inlet and an outlet disposed adjacent a center of the pulsator for guiding washing water from the inlet toward the center of the pulsator, a spurt cap arranged for guiding the washing water upwardly from the center of the pulsator; and a filter installed at the inlet of the guide duct for filtering out impurities from the washing water.

2. The clothes washing machine as claimed in claim 1, wherein the filter comprises side flanges, a first coupling jaw and a second coupling jaw, and a net, the side flanges being mounted in the inlet and defining a space, the first coupling jaw and the second coupling jaw being bent from opposite ends of the side flanges so as to respectively surround a first inflow end and a second inflow end of the inlet, the net being arranged in the space for filtering out impurities from the washing water when the washing water flows into the guide duct.

3. The clothes washing machine as claimed in claim 2, wherein the filter is frictionally assembled at the inlet.

4. The clothes washing machine as claimed in claim 1, wherein the filter comprises upper and lower side flanges, a first side tab and a second side tab, the side flanges being mounted in the inlet and defining a space, the first side tab and the second side tab extending outward from opposite ends of the side flanges so as to respectively be in contact with a first inflow end and a second inflow end of the inlet, protuberances protruding upwardly from a top of the upper side flange and downwardly from a bottom of the lower side flange, and a net arranged in the space for filtering out impurities from the washing water when the washing water flows into the guide duct.

5. The clothes washing machine as claimed in claim 4, wherein the guide duct comprises a plurality of assembling holes formed at a top and a bottom of the guide duct, the assembling holes having locations corresponding to locations of the protuberances so that the protuberances are inserted into respective assembling holes.

6. The clothes washing machine as claimed in claim 1, wherein the spurt cap comprises a canopy which is shaped like a frusto-arcuate disc having a spurt hole through which the washing water spurts.

7. The clothes washing machine as claimed in claim 6, wherein the canopy comprises a core and an arcuate rim, the core having a shape of a disc, the arcuate rim surrounding the core, the spurt hole being formed between the core and the arcuate rim.

8. The clothes washing machine as claimed in claim 7, wherein the core comprises a plurality of ribs which partition the spurt hole and reduce a cross sectional area of the spurt hole through which the washing water passes, so as to increase a spurting pressure of the washing water, the ribs preventing alien materials from entering the guide duct when no washing water is spurting from the spurt cap.

* * * * *